US005971824A

United States Patent [19]

Cho et al.

[11] Patent Number: 5,971,824

[45] Date of Patent: Oct. 26, 1999

[54] METHOD FOR MAKING PLASMA DISPLAY PANEL ELECTRODE

[75] Inventors: Jung Soo Cho; Chung Hoo Park, both of Pusan-si; Ki En Lee, Kyungsangbuk-do; Jae Hyun Ko, Kyungki-do; Jae Hwa Ryu, Kyungsangbuk-do, all of Rep. of Korea

[73] Assignee: LG Electronics, Inc., Rep. of Korea

[21] Appl. No.: 08/829,824

[22] Filed: Mar. 25, 1997

[30] Foreign Application Priority Data

Apr. 25, 1996 [KR] Rep. of Korea ..... 96/12931

[51] Int. Cl.[6] ..... H01J 9/02

[52] U.S. Cl. ..... 445/24

[58] Field of Search ..... 445/24, 51; 313/584

[56] References Cited

U.S. PATENT DOCUMENTS 3,942,061 3/1976 Van Esdonk et al. ..... 313/584

*Primary Examiner*—Kenneth J. Ramsey

*Attorney, Agent, or Firm*—Fish & Richardson P.C.

[57] ABSTRACT

An electrode for a plasma display panel (PDP) in which an electrode having a high adhesive power is formed on a glass substrate of a color plasma display panel and a method for forming the same. The electrode for the PDP includes a metal ceramic thin film formed between a metal electrode and a dielectric substrate. The method includes steps of forming a metal ceramic thin film on a predetermined portion of the dielectric substrate and forming an electrode having the same metal element as the metal ceramic thin film on the metal ceramic thin film.

15 Claims, 4 Drawing Sheets

METHOD FOR MAKING PLASMA DISPLAY PANEL ELECTRODE

BACKGROUND OF THE INVENTION

1. Field of the Invention

The present invention relates to an electrode for a plasma display panel (PDP) in which an electrode having a high adhesive power is formed on a glass substrate of a color plasma display panel; and a method for forming the same.

2. Discussion of the Related Art

FIG. 1 is a cross-sectional view showing a structure of a conventional PDP.

Referring to FIG. 1, a pair of upper electrodes 4 are formed on a front glass substrate. A dielectric layer 2 is formed over the pair of the upper electrodes 4 by employing a printing method and a protecting layer 3 is formed on the dielectric layer 2 by a deposition method. The pair of upper electrodes 4, and the dielectric layer 2 and the protecting layer 3 constitute an upper structure.

A lower electrode 12 is formed on a back glass substrate 11. Sidewalls 6 are formed in order to prevent crosstalk between adjacent cells. Luminescent materials 8, 9, and 10 are formed on the both sides of each of the sidewalls 6 and on the back glass substrate 11. The lower electrode 12, the sidewalls 6, and the luminescent materials 8, 9, and 10 constitute an lower structure. A non-active gas fills the space between the upper electrodes 4 and the lower electrode 12 such that a discharge region 5 is formed.

The operation of a general PDP will be explained.

Referring to FIG. 1, a driving voltage is applied to the pair of the upper electrodes 4 so that a surface discharge is generated in the discharge region 5, thereby generating ultraviolet 7. The ultraviolet 7 excites the luminescent materials 8, 9, and 10, to achieve a color display. In other words, the space charge which is present in the discharge cell is traveled to cathode due to the driving voltage. The space charge collides with non-active mixed gas which is a penning mixed gas added to by xenon (Xe), and neon (Ne), helium (He) which is the main component of the mixed gas, such that the non-active gas is exited and the ultraviolet 7 of 147 nm is generated. The non-active gas which fills the discharge has a pressure of 400–500 torr.

The ultraviolet 7 generated collides with the luminescent material 8, 9, and 10 on the sidewalls 6 and the back glass substrate 11, thus forming a visible ray region.

FIGS. 2*a* and 2*b* are cross-sectional views showing the upper and lower substrates of a PDP according to a conventional method.

As shown in FIG. 2*a*, for the lower substrate, a metal conductive material 30 such as nickel (Ni) or aluminum (Al) is formed on a back glass substrate 11 (dielectric substrate) by a printing technique. As shown in FIG. 2*b*, for the upper substrate, copper (Cu) 35 used as an electrode is formed in a front glass substrate 1 (dielectric substrate).

Cu, Ni, and Al all have a very low interfacial coherence with respect to glass. Thus, chromium (Cr) 40 is formed between glass and Cu 35, or between glass and Al 30 or Ni in order to maintain the coupling of the glass and the Cu 35, or that of the glass and the Al 30 or the Ni.

Referring to the forming process, a Cr thin film 40 is formed on the front glass substrate 1 of the PDP by means of a sputtering method in order to heighten the interfacial coherence. Then a Cu film (35) used as an electrode is formed on the Cr thin film 40. Next, another Cr thin film 40 is formed on the Cu film 35 using the sputtering method in order to heighten the interfacial coherence. Finally, employing annealing, a glass is made to cover the entire surface of the front glass substrate 1 inclusive of the Cu film 35 and the Cr thin films 40.

Like the glass substrate, a dielectric substrate is applied to the same manner as the glass substrate. In the same manner, there is formed the electrode on the front glass substrate 11 shown in FIG. 2*a*.

A conventional electrode of a PDP and a forming method thereof have the following disadvantages.

Since Cr is a pure metal, Cr has a poor interfacial coherence with respect to glass. Besides, in case glass is annealed at a high temperature, interfacial crack or foam is generated at the interface of the glass and the Cr due to their different expansions, and thus the discharge of the PDP becomes unstable and the life span of the PDP becomes shortened. Moreover, since the coupling is made by two metals that are Cu and Cr, that is, an electrode and an interfacial adhesives, sputtering process is carried out for the Cu and another sputtering process is also carried out for the Cr. Accordingly, the overall process is complicated.

SUMMERY OF THE INVENTION

The present invention is directed to an electrode of a plasma display panel (PDP) that substantially obviates one or more problems due to limitations and disadvantages of the related art.

An object of the invention is to provide an electrode of a plasma display panel (PDP) in which, on a glass substrate of a color plasma display panel, there is formed an electrode having a high adhesive power for improving a discharge condition of a PDP and its life span and a forming method thereof.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electrode of a PDP in which a metal electrode is formed on a dielectric substrate includes a metal ceramic thin film formed between the metal electrode and the dielectric substrate or a glass substrate In another aspect, a method for forming an electrode of a PDP in which a dielectric substrate and a metal electrode are formed includes the steps of forming a metal ceramic thin film on a predetermined portion of the dielectric substrate and forming an electrode having the same metal element as the metal ceramic thin film on the metal ceramic thin film.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1:
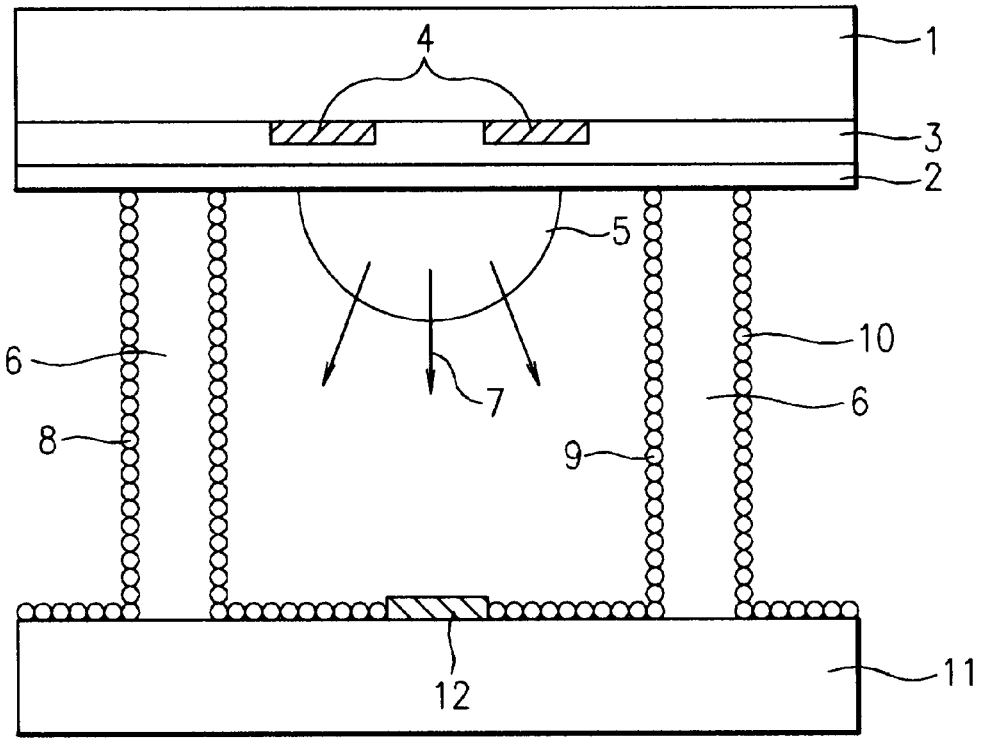
FIG.1 conventional art
FIG. 1 is a cross-sectional view showing a structure of a conventional PDP.
Figure 2A:
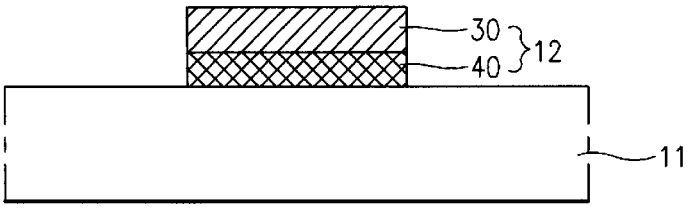
FIG.2a conventional art
FIG. 2*a* is a cross-sectional view showing a conventional electrode formed on a lower substrate of the conventional PDP of FIG. 1.
Figure 2B:
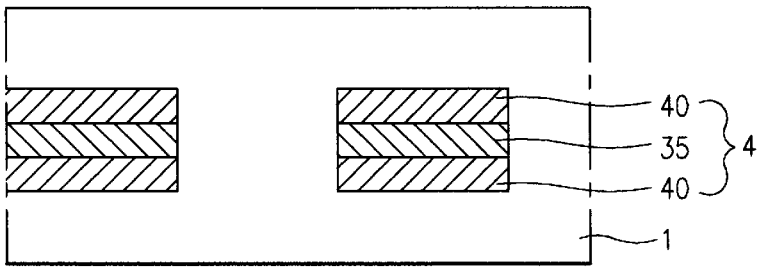
FIG.2b conventional art
FIG. 2*b* is a cross-sectional view showing a conventional electrode formed on an upper substrate of a PDP.
Figure 3A:
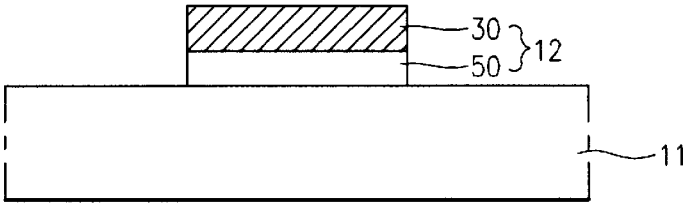
FIG. 3*a* is a cross-sectional view showing an electrode formed on an upper substrate of a PDP.
Figure 3B:
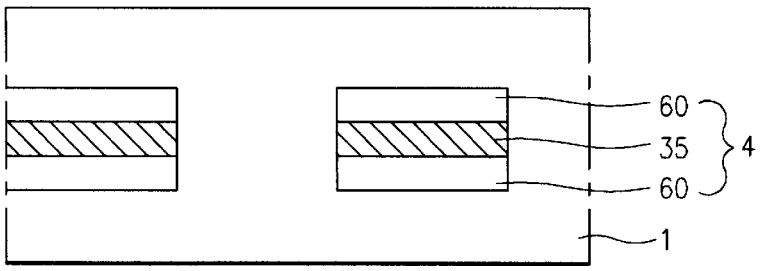
FIG. 3*b* is a cross-sectional view showing an electrode formed on a lower substrate of a PDP.

FIGS. 3*a* and 3*b* are cross-sectional views showing electrodes formed on upper and lower substrates, respectively.

In a PDP where a metal electrode is formed on a glass substrate or a dielectric substrate, a metal ceramic thin film having the same element as the metal electrode is formed in order to heighten the interfacial coherence between the metal electrode and the glass substrate or the dielectric substrate.

As shown in FIGS. 3*a* and 3*b*, a metal ceramic thin film, which is an interfacial adhesive, is formed between the back glass substrate (dielectric substrate) 11 and the lower electrode 12 or between the front glass substrate 1 and the upper electrode 4.

Referring to FIG. 3*a*, before a metal conductive material such as Ni or Al (30) is used as an electrode is deposited on the back glass substrate 11 by employing a printing method, a metal ceramic thin film, e.g. a nitride aluminum ($Al_xN$) ceramic thin film or an oxide aluminum ($Al_xO$) ceramic thin film 50 is formed by a reactive sputtering method.

Referring to FIG. 3*b*, Cu 35 used as electrodes is formed over the front glass substrate 1 (or dielectric substrate). In this case, before the formation of the Cu film 35 used as the electrodes, either a copper nitride ($Cu_xN$) ceramic thin film or an oxide aluminum ($Cu_xO$) ceramic thin film 60 which has the same element as the Cu film 35 is formed to have a thickness of thousands of Angstroms by employing a reactive sputtering method. Then the Cu film 35 is formed on the ceramic thin film 60. Next, another ceramic thin film 60 is formed on the Cu film 35.

If a metal is formed to be used as electrodes, before a Cu film 35 is formed on the glass substrate 1, a copper nitride ($Cu_xN$) ceramic thin film 60 is formed on the glass substrate 1 by employing a reactive sputtering method. Alternatively, a copper oxide ($Cu_xO$) ceramic thin film 60 is formed on the glass substrate 1 by employing the same sputtering method.

Thus, the reactive sputtering process is carried out only once on one metal, i.e., Cu. In other words, a sputtering is applied to the Cu metal over a predetermined region of the glass substrate. Next, argon (Ar) and nitrogen (N) are injected in a predetermined ratio, or argon and oxygen (O) are injected to carry out the reactive sputtering, thereby forming the copper nitride ceramic thin film or the copper oxide ceramic thin film 60. Thereafter, if argon is injected, or if a reactive sputtering is subjected to only copper, the copper metal layer 35 is formed.

Subsequently, argon and nitrogen are injected again in a predetermined ratio after a predetermined time, or argon and oxygen are injected appropriately to carry out another sputtering process so that a copper nitride ceramic thin film or a copper oxide ceramic thin film 60 is formed on the copper metal layer 35, thereby forming an electrode of a PDP.

The conditions of the reactive sputtering are as follows:

Driving pressure: 10 m Torr

Discharge voltage: 450 V

Discharge current: 100 mA

Ratio of the reactive gases ($N_2$/Ar): 15% or more

Deposition time: 10–20 minutes

Substrate bias voltage: −100 V or less

Figure 4A:
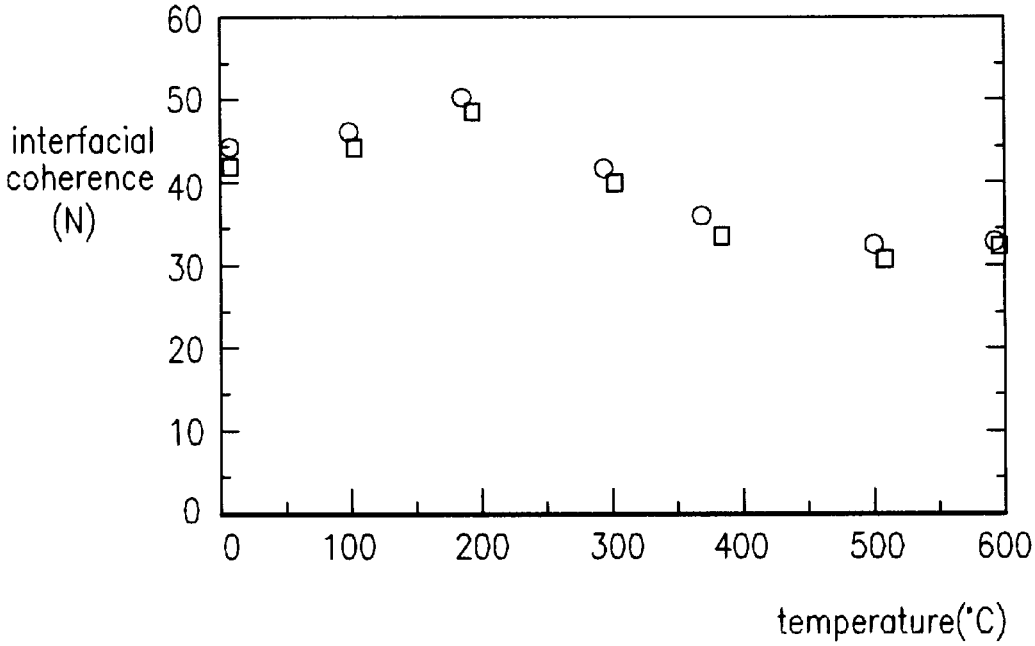
FIG. 4*a* is a graph showing interfacial coherence with respect to temperatures.
Figure 4B:
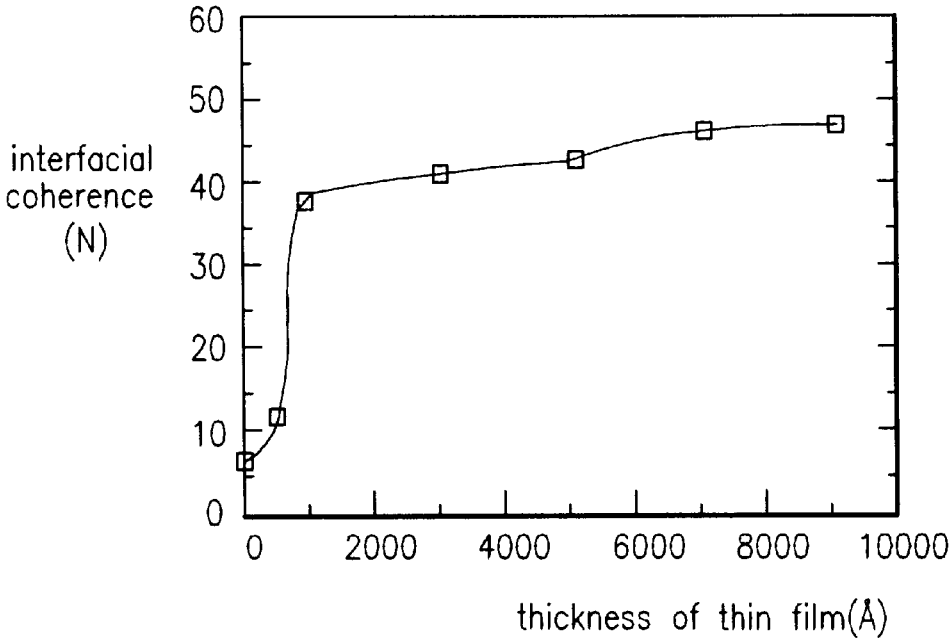
FIG. 4*b* is a graph showing interfacial coherence with respect to thicknesses of a ceramic thin film.
Figure 4C:
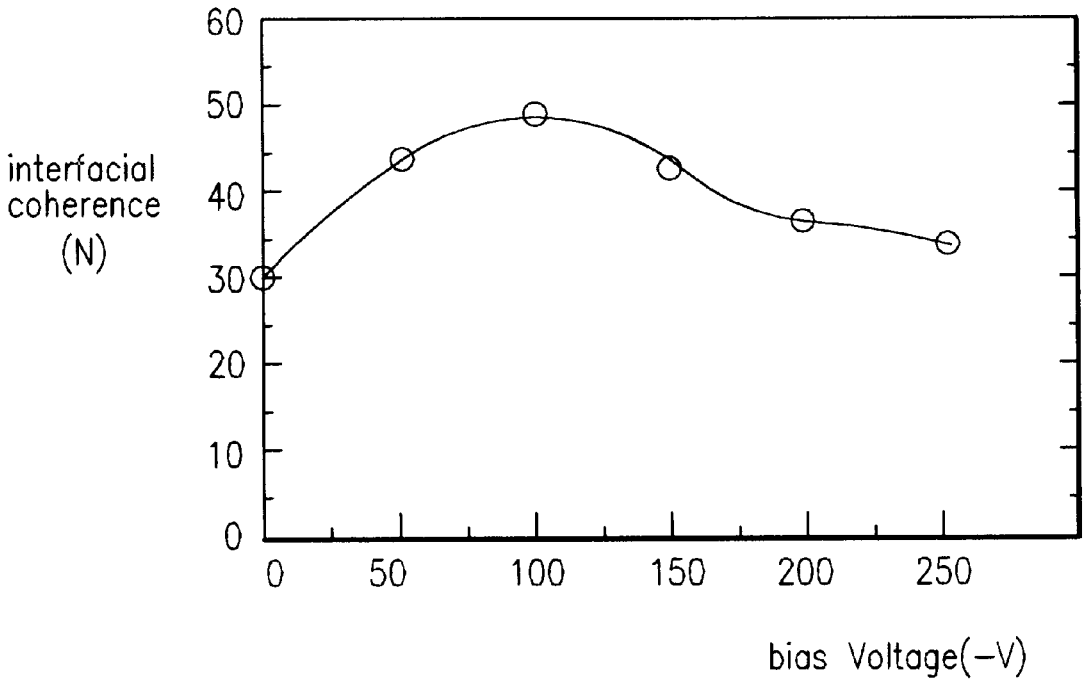
FIG. 4*c* is a graph showing interfacial coherence with respect to bias voltages.

As shown in FIGS. 4*a* through 4*c*, when the process is performed under the above-described conditions, the adhesive power is very good with regard to temperature, thickness of the ceramic thin film, and bias voltage. This process is applied to the front glass substrate 11, as well.

The electrode of a PDP and the manufacturing method thereof have the followings advantages.

Since the electrode of the PDP has a structure of metal ceramic thin film/metal/metal ceramic thin film, the interfacial adhesive power between the metals is improved, and interfacial flaking, interfacial crack, or interfacial foam is not generated when annealing is performed. Thus, discharge characteristics are improved, and the life span of a PDP is prolonged. Moreover, since a metal for interfacial adhesiveness is the same metal as a metal for an electrode when sputtering is carried out, or since only mood of the reactive gas is changed, the process of forming a metal ceramic thin film is simplified and the overall process of manufacturing a PDP is significantly simplified.

It will be apparent to those skilled in the art that various modification and variations can be made in the electrode of a plasma display panel (PDP) of the present invention without departing from the spirit or scope of the inventions. Thus, it is intended that the present invention cover the modifications and variations of this invention provided they come within the scope of the appended claims and their equivalents.

What is claimed is:

1. A method for forming an electrode for a plasma display panel (PDP) in which a dielectric substrate and a metal electrode are formed, the method comprising the steps of:

forming a metal ceramic thin film on a predetermined portion of a dielectric substrate; and, forming an electrode of the same element as the metal ceramic thin film on the metal ceramic thin film.

2. The method as claimed in claim 1, wherein said metal electrode and said metal ceramic thin film are sputtered as a metal target of the same element.

3. The method as claimed in claim 1, wherein said metal ceramic thin film is either a metal nitride ceramic thin film formed by a reactive sputtering process employing a mixed gas mixed argon and nitrogen in an appropriate ratio over the metal electrode or a metal oxide ceramic thin film formed by a reactive sputtering process employing a mixed gas mixed with argon and oxygen over the metal electrode.

4. The method as claimed in claim 1, wherein said electrode is made of Cu or Al.

5. The method as claimed in claim 1, wherein said metal ceramic thin film is formed by selective reaction of argon and nitrogen ($N_2$) over either Cu or Al, or argon and oxygen ($O_2$) over either Cu or Al.

6. The method as claimed in claim 1, wherein the successive formations of the dielectric substrate, the metal ceramic thin film, and the metal electrode are a process of manufacturing an upper substrate.

7. A method for forming an electrode for a plasma display panel (PDP) in which a dielectric substrate and a metal electrode are formed, the method comprising the steps of:

forming a metal ceramic thin film on a predetermined portion of the dielectric substrate;

forming an electrode of the same metal element as the metal ceramic thin film on the metal ceramic thin film; and, forming a ceramic thin film of the same metal element on the electrode, and covering the thin films inclusive of the electrode with the dielectric substrate.

8. The method as claimed in claim 7, wherein said electrode and said metal ceramic thin film are sputtered as one metal target of the same element.

9. The method as claimed in claim 7, wherein said metal ceramic thin film is either a metal nitride ceramic thin film formed by a reactive sputtering process employing a mixed gas mixed with argon and nitrogen over in an appropriate ratio over the metal electrode or a metal oxide ceramic thin film formed by a reactive sputtering process employing a mixed gas mixed with argon and oxygen over the metal electrode.

10. The method as claimed in claim 7, wherein said electrode is either Cu or Al.

11. The method as claimed in claim 7, wherein said metal ceramic thin film is formed by selective reaction employing argon and nitrogen over copper or over aluminum or argon and oxygen over copper or over aluminum.

12. The method as claimed in claim 7, wherein successive formations of the dielectric substrate, the metal ceramic thin film, the metal electrode, the metal ceramic thin film, and the dielectric substrate are a process of manufacturing a lower substrate.

13. A method for forming an electrode for a plasma display panel (PDP) in which a first metal electrode is formed in a first dielectric substrate and a second metal electrode is formed over a second dielectric substrate, the method comprising;

an upper substrate including a ceramic thin film of the same element as a second metal formed between the second dielectric substrate and the second metal electrode; and, a lower substrate including a ceramic thin film of the same element as a first metal formed on both sides of the first metal electrode in the first dielectric substrate.

14. The method as claimed in claim 13, wherein said first ceramic thin film of the first metal and said second ceramic thin film of the second metal are formed by oxidation or nitrating over the same metals of the first and second metal electrodes, respectively.

15. The method as claimed in claim 13, wherein said first and second metal electrodes are made of Cu or Al.

* * * * *